US008033303B2

(12) United States Patent
Kusakari et al.

(10) Patent No.: US 8,033,303 B2
(45) Date of Patent: Oct. 11, 2011

(54) WIRE CURL DIAMETER ADJUSTING MECHANISM FOR TYING MACHINE

(75) Inventors: Ichiro Kusakari, Tokyo (JP); Takahiro Nagaoka, Tokyo (JP); Osamu Itagaki, Tokyo (JP); Akira Kasahara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 652 days.

(21) Appl. No.: 12/279,893

(22) PCT Filed: Feb. 20, 2007

(86) PCT No.: PCT/JP2007/053105

§ 371 (c)(1),
(2), (4) Date: Aug. 19, 2008

(87) PCT Pub. No.: WO2007/097342

PCT Pub. Date: Aug. 30, 2007

(65) Prior Publication Data

US 2010/0224278 A1 Sep. 9, 2010

(30) Foreign Application Priority Data

Feb. 21, 2006 (JP) ..... 2006-043773

(51) Int. Cl.
*B21F 15/06* (2006.01)
*B21F 9/02* (2006.01)

(52) U.S. Cl. ..... 140/119; 140/118; 140/93.6

(58) Field of Classification Search ..... 140/93.2, 140/119, 93.6, 57, 118; 100/31
See application file for complete search history.

(56) References Cited

U.S. PATENT DOCUMENTS 5,558,134 A * 9/1996 Miyazaki ..... 140/57
5,956,989 A * 9/1999 Kusakari ..... 140/119

FOREIGN PATENT DOCUMENTS

| | | |
|---|---|---|
| DE | 43 00 247 A1 | 11/1993 |
| DE | 44 39 927 A1 | 5/1995 |
| JP | 7-132914 | 5/1995 |
| JP | 8-277632 | 10/1996 |

* cited by examiner

*Primary Examiner* — Edward Tolan
*Assistant Examiner* — Mohammad Ibrahim Yusuf
(74) *Attorney, Agent, or Firm* — Drinker Biddle & Reath LLP

(57) ABSTRACT

Two guide pins 11 and 12 formed upright in a guide plate 7 are received in guide pin fitting holes 13 and 14 formed in a guide member 8. Fixed screws 23*a* and 23*b* are screw-connected to the guide pins 11 and 12. One guide pin 12 is fitted to the corresponding guide pin fitting hole 14 with a play. Screw holes 20 and 21 are formed through the inner surface of the guide pin fitting hole 14 and the outer surface of the guide member 8. An angle of the guide member 8 with respect to the guide plate 7 is adjusted by allowing front ends of embedded screws 22*a* and 22*b* respectively screw-inserted in the screw holes 20 and 21 to respectively engage with a peripheral surface of the guide pin 12.

6 Claims, 5 Drawing Sheets

WIRE CURL DIAMETER ADJUSTING MECHANISM FOR TYING MACHINE

TECHNICAL FIELD

The present invention relates to a wire curl diameter adjusting mechanism for a tying machine.

BACKGROUND ART

Generally, in a rebar tying machine, it is important to reduce errors by ensuring a sufficient tying force. Accordingly, a desired curl diameter has to be formed. In order to obtain the desired curl diameter, it is necessary to decrease a non-uniform degree of the curl diameter during a production or to increase a tying width of the curl diameter of the tying machine itself.

Various members are used to form the curl diameter, so that it is difficult to form a predetermined curl diameter due to tolerances of the members . In particular, when a diameter of a rebar as an object to be tied is large, it is necessary to increase the curl diameter. When the curl diameter is large, a problem arises in that a production is difficult because required processing precision becomes very strict.

Therefore, it may be supposed that the above-described problem is handled by adjusting the attachment positions of the members used to form the curl diameter. Accordingly, it is possible to form the correct curl diameter by adjusting errors caused by the tolerances of the members (for instance, see JP-A-07-132914).

Incidentally, in members for guiding a wire so as to form a curl diameter, some of the members may tend to clog the wire. Particularly, the wire clogging may easily occur in a front-end guide member which is the most important to form the curl diameter. For instance, when the tying machine is operated in a state where there is a very little remaining amount of the tying wire wound around a wire reel, a feed operation is stopped in a state where the front end of the wire does not protrude from the guide member. As a result, a problem arises in that the cut tying wire remains in the tying machine. Since it is not possible to remove the remaining wire to the outside, a user needs to detach the guide member so as to remove the remaining wire. At this time, after the detaching operation, it is necessary to again attach the guide member to an original position.

However, as described above, since the wire curl diameter is adjusted by a very delicate operation and the curl diameter becomes different when the attachment position of the guide member is slightly different, it is very difficult for a user to attach the guide member to the original position. As a result, a problem arises in that troubles occur in a tying operation after the detaching operation.

DISCLOSURE OF THE INVENTION

One or more embodiments of the invention provide a wire curl diameter adjusting mechanism for a tying machine capable of keeping a curl diameter even when a user detaches members for forming the curl diameter and of reducing required processing precision for the members.

According to the one or more embodiments of the invention, in a first aspect of the invention, a tying machine is provided with: a feed part which feeds out a tying wire from a wire reel around which the tying wire is wound; a guide part which forms the tying wire fed out from a front end of the feed part in a loop shape around an object to be tied; and a twist part which grasps and twists the loop shaped tying wire. A guide member is screw-connected to a side of a fixed guide portion which is integrally formed with a tying machine body so as to protrude in a beak shape. The tying wire is fed out along a guide groove formed between the guide part and the guide member. The curl diameter of the wire fed out therefrom is adjusted by adjusting the position of the guide member. Two guide pins formed upright in the fixed guide portion are screw-fixed to guide pin fitting holes formed in the guide member while being received therein. One guide pin is fitted to the corresponding guide pin fitting hole with a play. A screw hole is formed through the inner surface of the guide pin fitting hole and the outer surface of the guide member. An angle of the guide member with respect to the fixed guide portion is adjusted in such a manner that a front end of an embedded screw screw-inserted in the screw hole engage with the peripheral surface of the guide pin.

In a second aspect of the invention, two screw holes may be formed on both sides on a line connecting the two guide pin fitting holes.

In a third aspect of the invention, the front end of the embedded screw may engage with the peripheral surface of a hollow pin fitted to the guide pin instead of the peripheral surface of the guide pin.

According to the first aspect of the invention, since a gap is formed between the one guide pin and the guide pin fitting hole when the two guide pins of the fixed guide portion are fitted to the guide pin fitting holes of the guide member, the guide member can swing about the guide pin without a gap therebetween. Then, it is possible to adjust the angle of the guide member with respect to the fixed guide portion in such a manner that the embedded screws are respectively screw-inserted into the screw holes and a screw-insertion amount thereof is adjusted. Since the wire curl diameter is set by the angle of the guide member, it is possible to adjust the wire curl diameter. Then, the guide member may be screw-fixed to the guide pin after the position is adjusted.

When attaching the guide member after the detaching operation, the positional relationship between the guide member and the guide pin is set at the same position as that before the detaching operation by use of the embedded screws. Accordingly, it is possible to attach the guide member so as to have the correct curl diameter without any additional adjustment.

Since the correct curl diameter is obtained by adjusting the guide member, it is possible to reduce required processing precision for the members such as the guide pin of the fixed guide portion or the guide member.

According to the second aspect of the invention, since two screw holes are formed on both sides on the line connecting the guide pin fitting holes, the number of the screw holes and the embedded screws may be two, respectively, and the angle of the guide member can be efficiently adjusted.

According to the third aspect of the invention, since the embedded screw directly engage with the hollow pin, it is possible to protect the guide pin.

Other aspects and advantages of the invention will be apparent from the following description, the drawings and the claims.

DESCRIPTION OF REFERENCE NUMERALS AND SIGNS

1: TYING MACHINE BODY
3: TYING WIRE
7: GUIDE PLATE
8: GUIDE MEMBER
10: WIRE GUIDE GROOVE
11: FIRST GUIDE PIN
12: SECOND GUIDE PIN
13: FIRST GUIDE PIN FITTING HOLE
14: SECOND GUIDE PIN FITTING HOLE
20: FIRST SCREW HOLE
21: SECOND SCREW HOLE
22*a*, 22*b*: EMBEDDED SCREW

BEST MODE FOR CARRYING OUT THE INVENTION

Hereinafter, an exemplary embodiment of the invention will be described with reference to the accompanying drawings.

Figure 1:
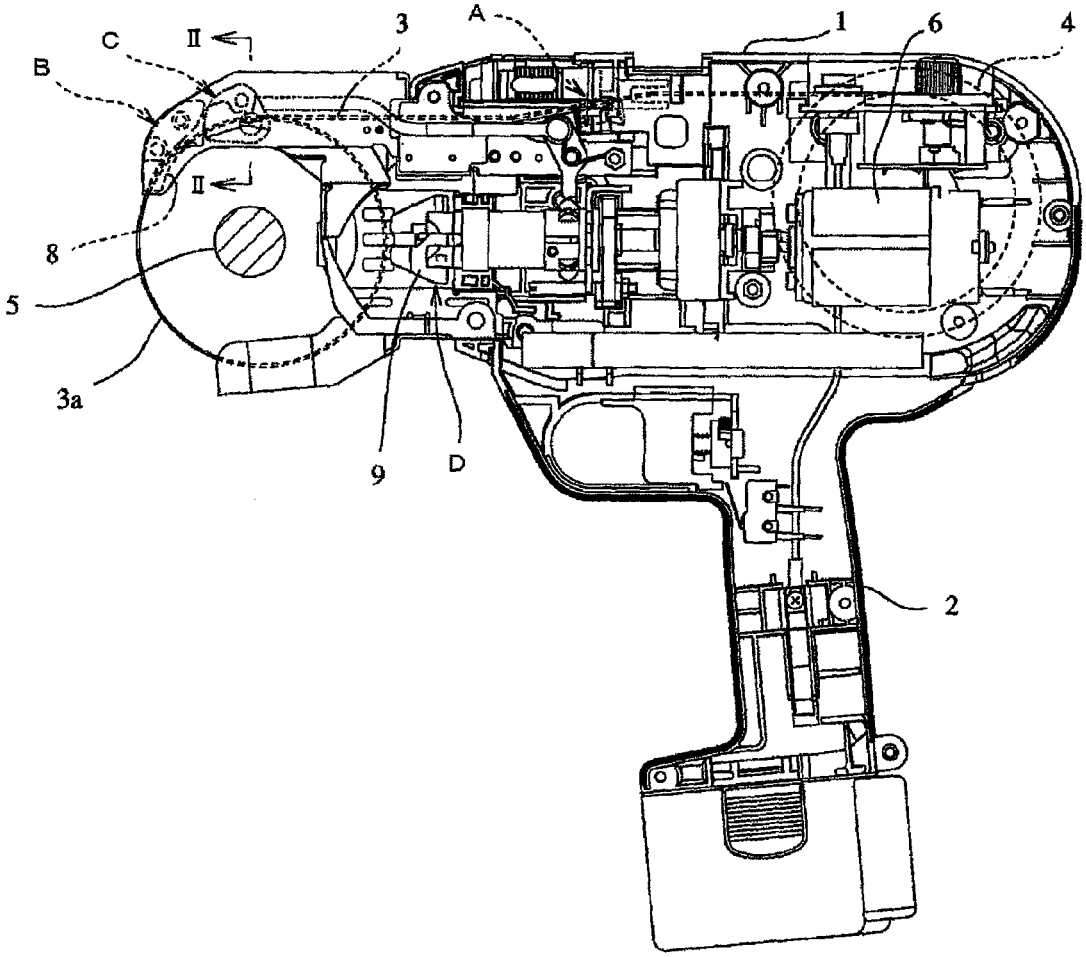
FIG. 1 is a longitudinal sectional diagram illustrating a tying machine related to the invention.

In FIG. 1, Reference Numeral 1 denotes a tying machine body and Reference Numeral 2 denotes a grip. The tying machine body 1 includes a feed part A which feeds out a tying wire 3 from a wire reel 4 around which the tying wire 3 is wound; a guide part B which allows the tying wire 3 fed out from the front end of the feed part A to be formed in a loop shape around an object to be tied 5; a twist part D which grasps and twists the tying wire 3 formed in a loop shape; and a cut part C which cuts the tying wire 3. In addition, the guide part B is integrally formed with the tying machine body 1 so as to protrude in a beak shape, and a wire receiving part 6 is formed at a position opposite to the guide part B. Then, a feed motor (not shown) of the feed part A allows the tying wire 3 wound around the wire reel 4 to take a bending posture by using the guide part B which is integrally formed with the tying machine body 1 so as to protrude in a beak shape so that the tying wire 3 is formed in a loop shape at a space between the guide part B and the wire receiving part 6 provided at a position opposite to the guide part B. Subsequently, the tying wire 3 is cut by the cut part C. Subsequently, a twist hook 9 moves forward in a protruding manner from the center of the tying machine body 1 so as to grip both sides of a wire loop 3*a* and then twists the tying wire 3 by rotating a motor 9*a* of the twist part D so as to decrease a diameter of the tying wire 3, thereby tying the object to be tied 5 inserted in the wire loop 3*a*. A battery is attached to the lower portion of the grip 2 so as to drive the two motors 2. The above-described mechanism is already known.

Figure 2:
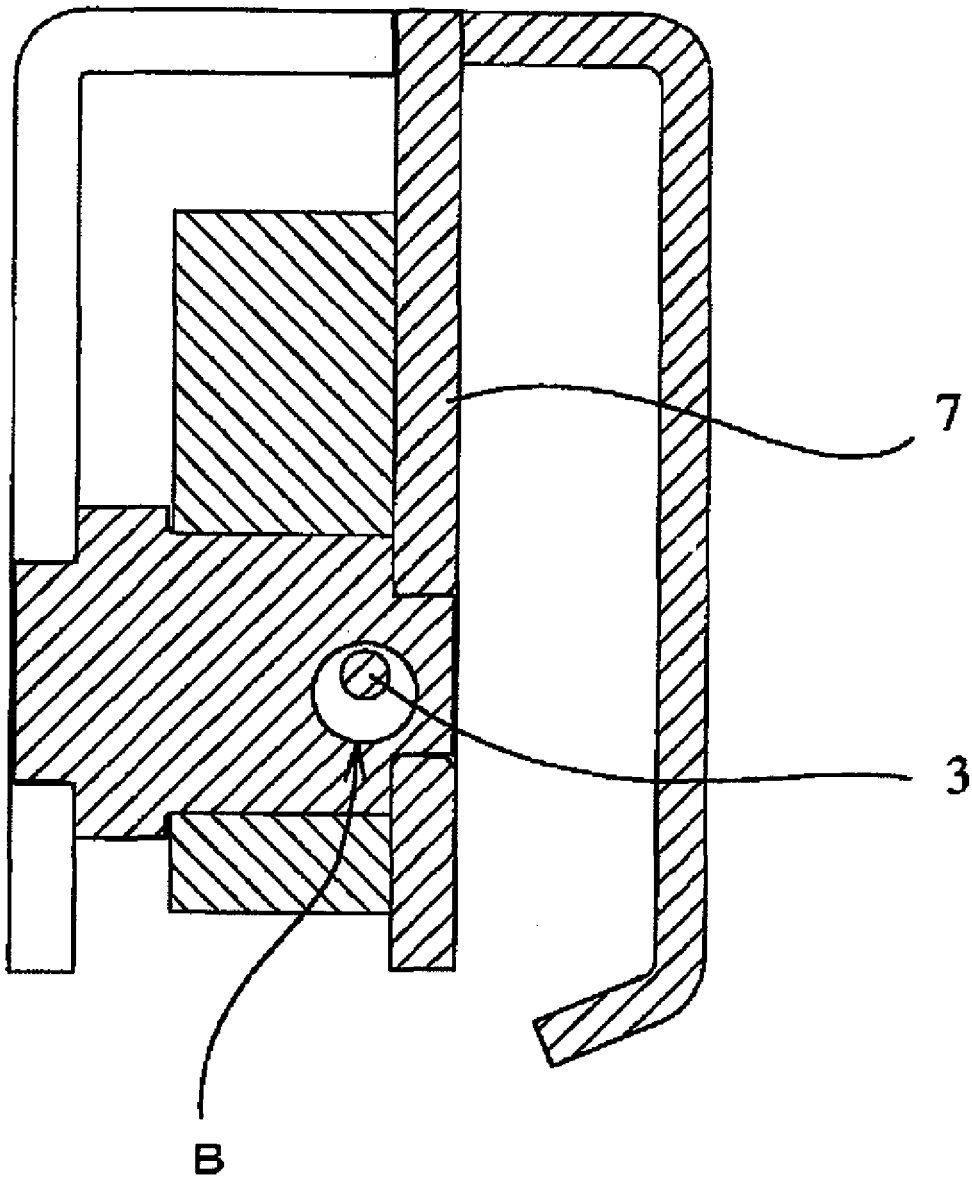
FIG. 2 is an enlarged diagram taken along the line II-II shown in FIG. 1.
Figure 3:
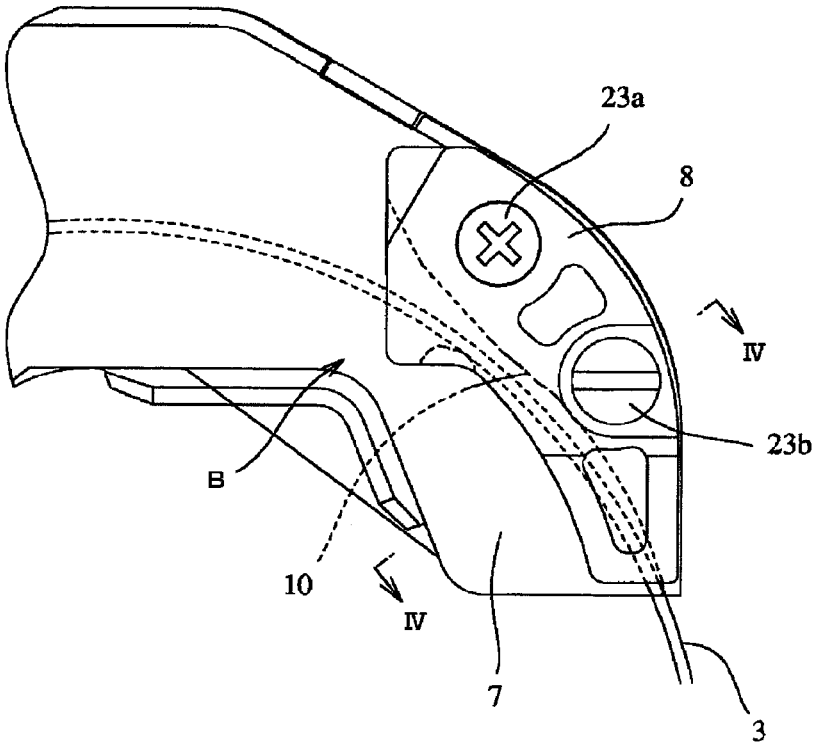
FIG. 3 is an enlarged diagram illustrating a main part shown in FIG. 1.
Figure 4:
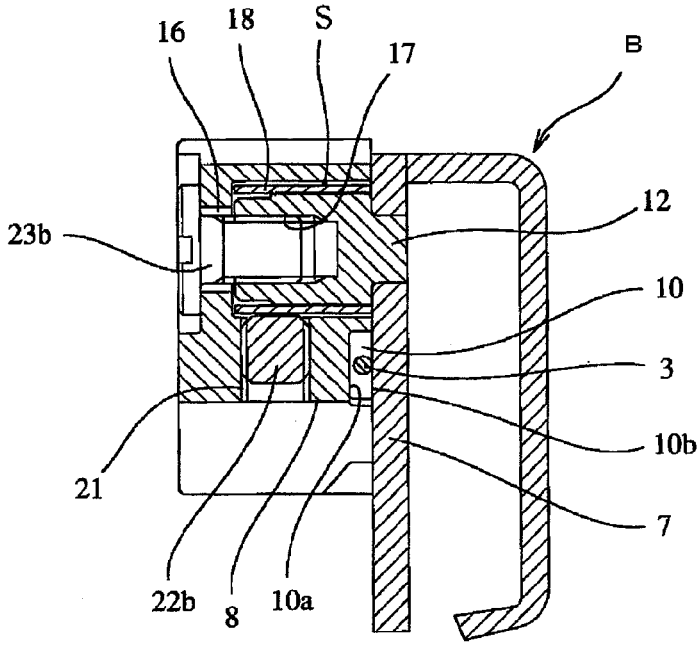
FIG. 4 is an enlarged sectional diagram taken along the line IV-IV shown in FIG. 3.
Figure 5:
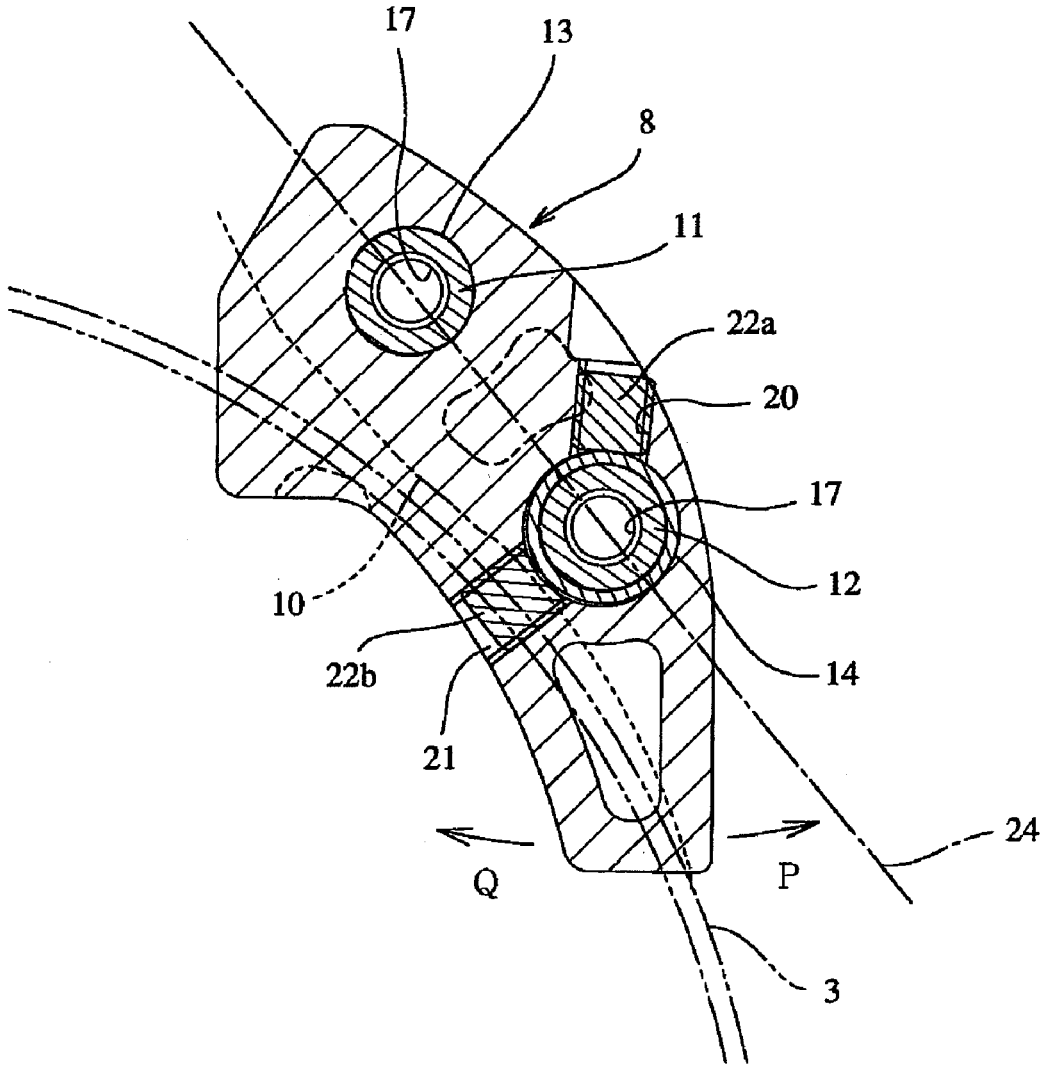
FIG. 5 is a longitudinal sectional diagram illustrating a guide member and a guide pin.
Figure 6:
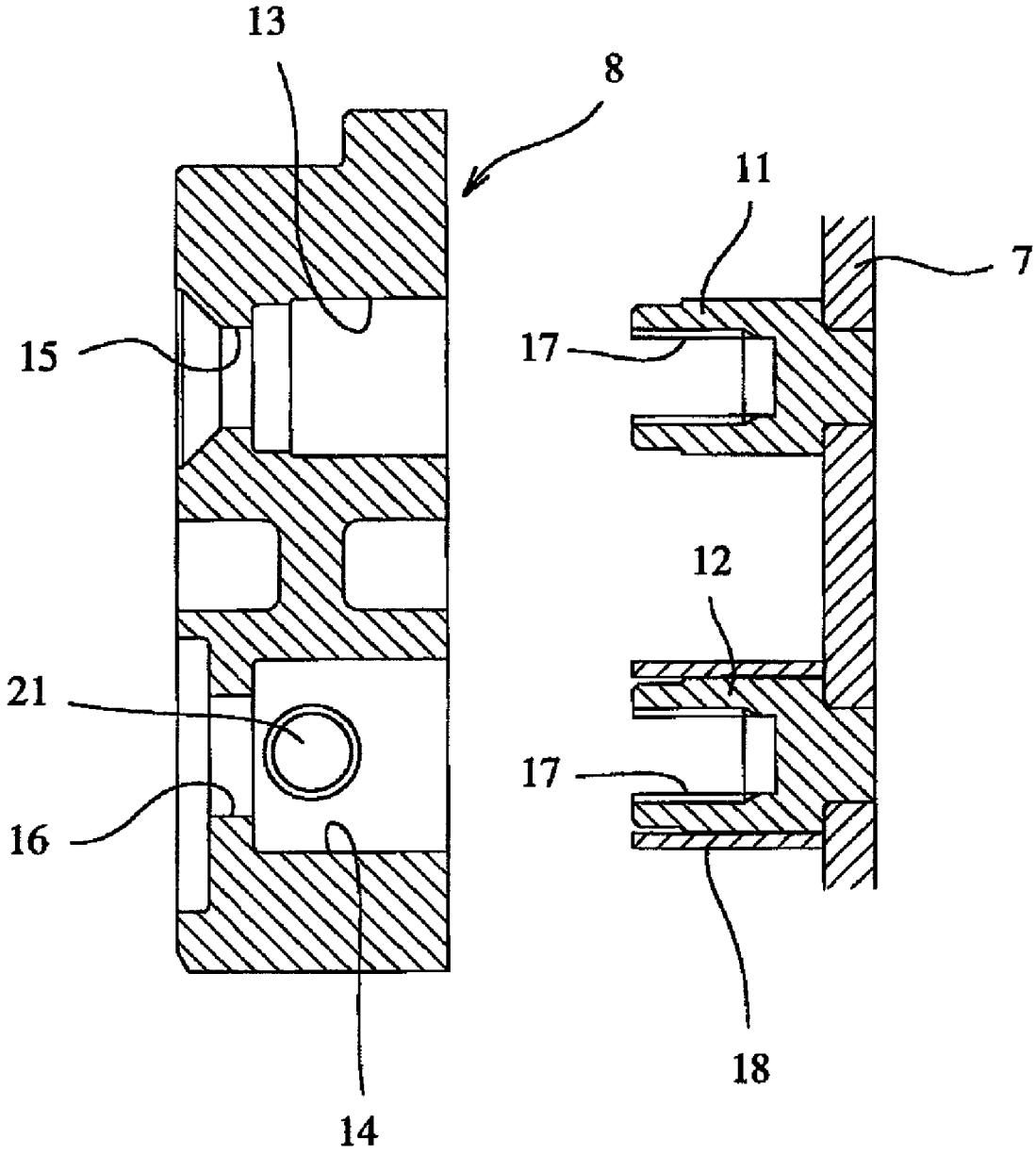
FIG. 6 is an exploded sectional diagram illustrating a guide plate and the guide member.

Incidentally, as shown in FIG. 2, the tying wire 3 fed to the guide part B is first linearly guided by a base of the guide part B, and then is guided by the front end thereof so as to take a bending posture. As shown in FIGS. 3 and 4, the guide part B includes a guide plate 7 which is integrally formed with the tying machine body 1 so as to extend therefrom and a guide member 8 which is screw-connected to the guide plate 7. Then, a groove portion 10*a* is formed in a rear surface of the guide member 8 so as to have an L-shape in a sectional view. A guide groove 10 is curved between the groove portion 10*a* and a surface 10*b* of the guide plate 7 so as to have a U-shape in a sectional view, so that the tying wire 3 is guided along the guide groove 10. Accordingly, an angle of the guide groove 10 varies in accordance with an angle of the guide member 8 with respect to the guide plate 7. In addition, a curl diameter of the tying wire 3 varies in accordance with a different bending degree of the tying wire 3 passing through the guide groove 10.

That is, as shown in FIGS. 3 to 6, two guide pins 11 and 12 (a first guide pin 11 and a second guide pin 12) are formed upright at positions on the sides of a base and a front end of the surface 10*b* of the guide plate 7, respectively. Screw holes 17 are respectively formed at the centers of the guide pins 11 and 12. On the other hand, guide pin fitting holes 13 and 14 (a first guide pin 13 and a second guide pin 14) are formed in the guide member 8 so as to correspond to the two guide pins 11 and 12. Screw insertion holes 15 and 16 are respectively formed in the upper portions of the guide pin fitting holes 13 and 14.

Incidentally, the base-side guide pin fitting hole 13 among the two guide pin fitting holes 13 and 14 is formed so that the inner diameter is approximately identical with the outer diameter of the guide pin 11 and the guide pin 11 is fitted to the guide pin fitting hole 13 without a gap therebetween. On the contrary, a hollow pin 18 is fitted to the front end-side guide pin 12, and the inner diameter of the front end-side guide pin fitting hole 14 is larger than the outer diameter of the guide pin 12 including the hollow pin 18, so that a gap S is formed between the guide pin 12 and the guide pin fitting hole 14.

Next, two screw holes (a first screw hole 20 and a second screw hole 21) are formed in the inner surfaces of the guide pin fitting holes 13 and 14 so as to penetrate the outer surface of the guide member 8. The screw holes 20 and 21 are formed on both sides on a line 24 connecting the centers of the two guide pin fitting holes 13 and 14, and embedded screws 22*a* and 22*b* are screw-inserted therein.

When attaching the guide member 8 with the above-described configuration to the guide plate 7 in a factory, the guide pins 11 and 12 of the guide plate 7 are received in the guide pin fitting holes 13 and 14 of the guide member 8. At this time, the base-side guide pin 11 is fitted to the guide pin fitting hole 13, and the front end-side guide pin 12 is fitted to the guide pin fitting hole 14 with a gap S therebetween in a state where the hollow pin 18 is fitted to the front end-side guide pin 12.

Since the gap S is formed between the hollow pin 18 and the guide pin fitting holes 13 and 14, the guide member 8 can swing about the base-side guide pin 11. Then, the first screw hole 20 and the second screw hole 21 are formed on both sides on a line 24 connecting the centers of the two guide pin fitting holes 13 and 14. Accordingly, when the front end of the embedded screw 22*a* screw-inserted into the first screw hole 20 engages with the peripheral surface of the hollow pin 18, if a screw-insertion amount thereof increases, the guide member 8 moves in a direction indicated by the arrow P shown in FIG. 5. Additionally, when the front end of the embedded screw 22*b* screw-inserted into the second screw hole 21 engages with the peripheral surface of the hollow pin 18, if a screw-insertion amount thereof increases, the guide member 8 moves in a direction indicated by the arrow Q shown in the same drawing. In this way, since the guide member 8 moves in the opposite directions indicated by the arrows P and Q by adjusting the screw-insertion amount of the two embedded screws 22*a* and 22*b*, it is possible to adjust the angle. Since an angle of the wire guide groove 10 of the guide member 8 is set by the angle of the guide member 8 and a curl diameter 3*a* of the tying wire 3 is set by the angle of the wire guide groove 10, the curl diameter 3*a* of the tying wire 3 is set by the angle of the guide member 8. Accordingly, it is possible to adjust the curl diameter 3*a* of the tying wire 3 by adjusting the angle of the guide member 8. Then, as shown in FIG. 3, fixed screws 23*a* and 23*b* may be inserted from the screw insertion holes 15 and 16 of the guide pin fitting holes 13 and 14 so as to be screw-inserted into the screw holes 17 of the guide pins 11 and 12.

Since the curl diameter 3*a* of the tying wire 3 is adjusted in this way at the factory shipment, for instance, even when a user has to detach the guide member 8 due to a wire clogging in use, it is possible to attach the guide member 8 in a state where the positional relationship of the guide member 8 and the guide pins 11 and 12 are the same as the positional relationship before the detaching operation in such a manner that the guide pin 11 is fitted to the guide pin fitting hole 13 formed in the guide member 8 and the guide pin 12 is fitted to the hollow pin 18 fixed to the guide pin fitting hole 14 by use of the configuration in which the hollow pin 18 is integrally formed with the guide member 8 and the position of the hollow pin 18 is set by the embedded screws 22*a* and 22*b*. Accordingly, it is possible to attach the guide member 8 so as to have the correct curl diameter 3*a* without any additional adjustment.

Since the correct curl diameter 3*a* is obtained by adjusting the guide member 8, it is possible to reduce required processing precision for the members such as the guide pins 11 and 12 of the guide plate 7 or the guide member 8.

When the embedded screws 22*a* and 22*b* directly engage with the peripheral surface of the guide pin 12, scratches occur in the peripheral surface. For this reason, when the guide member 8 is exchanged several times, scratches occurred in the guide pin 12 become large. The hollow pin 18 is prepared so as to prevent scratches from occurring in the guide pin 12. Accordingly, the embedded screws 22*a* and 22*b* may directly engage with the guide pin 12.

The number of the screw holes into which the embedded screws 22*a* and 22*b* are screw-inserted is not limited to two.

The arrangement position of the screw hole is not limited to the positions on both sides on the line 24 connecting the centers of the two guide pin fitting holes 13 and 14.

While the invention has been described with reference to the specific embodiment, it will be obvious to those skilled in the art that various changes and modification may be made therein without departing from the present invention.

This application is based on a Japanese Patent application No. 2006-043773 filed on Feb. 21, 2006, the entire contents of which are incorporated herein by reference.

INDUSTRIAL APPLICABILITY

The present invention is applicable to a wire curl diameter adjusting mechanism for a tying machine.

The invention claimed is:

1. A tying machine comprising:

a feed part that feeds out a tying wire from a wire reel around which the tying wire is wound;

a guide part that forms the tying wire fed out from a front end of the feed part in a loop shape around an object to be tied; and a twist part that grasps and twists the loop shaped tying wire, wherein the guide part includes:

a fixed guide portion integrally formed with a tying machine body and protruding from the tying machine body;

a guide member provided on a side of the fixed guide portion;

a first guide pin fitting hole;

a second guide pin fitting hole;

a first guide pin that is received in the first guide pin fitting hole;

a second guide pin that is received in the second guide pin fitting hole with a play; and a screw hole penetrating from an inner surface of the second guide pin fitting hole to an outer surface of the guide member, and wherein an angle of the guide member with respect to the fixed guide portion is adjusted by engaging a front end of an embedded screw screw-inserted in the screw hole with the second guide pin.

2. The tying machine according to claim 1, wherein the first guide pin is fitted to the first guide pin fitting hole without a gap therebetween.

3. The tying machine according to claim 1, wherein the first and second guide pin fitting holes are formed in the guide member, and wherein the first and second guide pins are provided in the fixed guide portion.

4. The tying machine according to claim 1, wherein the screw hole comprises a first screw hole formed on one side of a line connecting centers of the first and second guide pin fitting holes and a second screw hole formed on the other side thereof.

5. The tying machine according to claim 1, wherein the front end of the embedded screw engages with a peripheral surface of the second guide pin.

6. The tying machine according to claim 1, wherein the front end of the embedded screw engages with the second guide pin through a peripheral surface of a hollow pin fitted to the second guide pin.

* * * * *